United States Patent [19]

Arneson

[11] 4,098,453

[45] Jul. 4, 1978

[54] PACKAGING CONTAINER WITH LATCHING ARRANGEMENT

[75] Inventor: Edwin L. Arneson, Morris, Ill.

[73] Assignee: Federal Paper Board Co., Inc., Montvale, N.J.

[21] Appl. No.: 752,082

[22] Filed: Dec. 20, 1976

[51] Int. Cl.[2] ..... B65D 1/34; B65D 5/66

[52] U.S. Cl. ..... 229/45; 229/2.5 R

[58] Field of Search ..... 229/2.5 R, 2.5 EC, 29 M, 229/44, 45

[56] References Cited

U.S. PATENT DOCUMENTS

| | | | |
|---|---|---|---|
| 3,246,829 | 4/1966 | Sexton | 229/31 R |
| 3,511,433 | 5/1970 | Andrews et al. | 229/2.5 X |
| 3,876,130 | 4/1975 | Haase | 229/2.5 R |
| 3,938,726 | 2/1976 | Holden, Jr. et al. | 229/2.5 R |
| 3,938,727 | 2/1976 | Andersson | 229/2.5 R |
| 3,968,921 | 7/1976 | Jewell | 229/45 R |

*Primary Examiner*—Davis T. Moorhead
*Attorney, Agent, or Firm*—Guy A. Greenawalt

[57] ABSTRACT

A packaging container which is die formed or stamped from a single blank of paperboard, or like material, and characterized by a pair of tray-like members, each having an outturned peripheral edge flange formation, with a hinge connection along one side so that the members may be closed upon each other with the edge flange formations overlying each other, and cooperating latching members formed in outward extensions of the flange portions along the side opposite the hinge connection which are engageable to securely hold the container members in closed condition and prevent accidental opening of the same when subjected to careless handling.

1 Claim, 9 Drawing Figures

FIG. 1
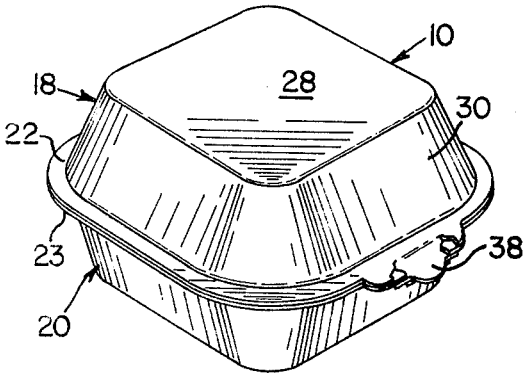
FIG. 2
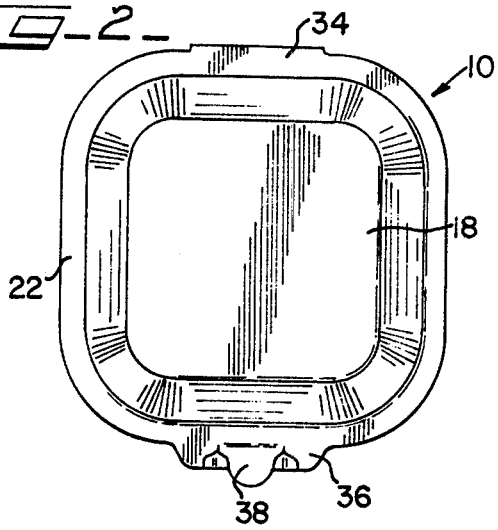
FIG. 3
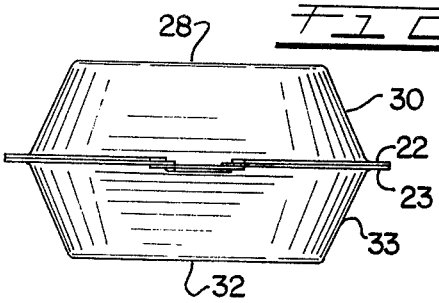
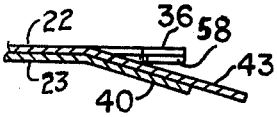
FIG. 5
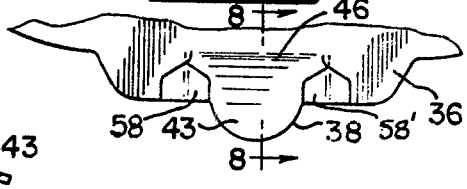
FIG. 8
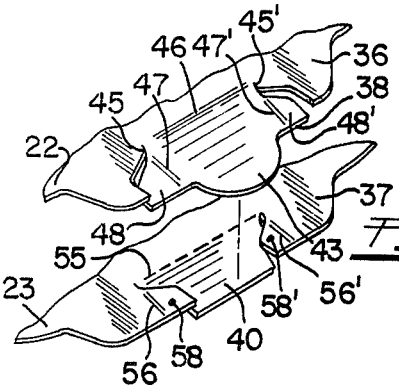
FIG. 6
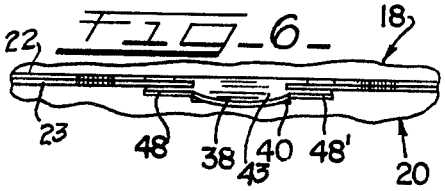
FIG. 4
FIG. 7
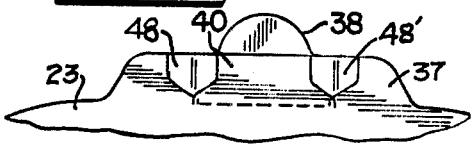
FIG. 9
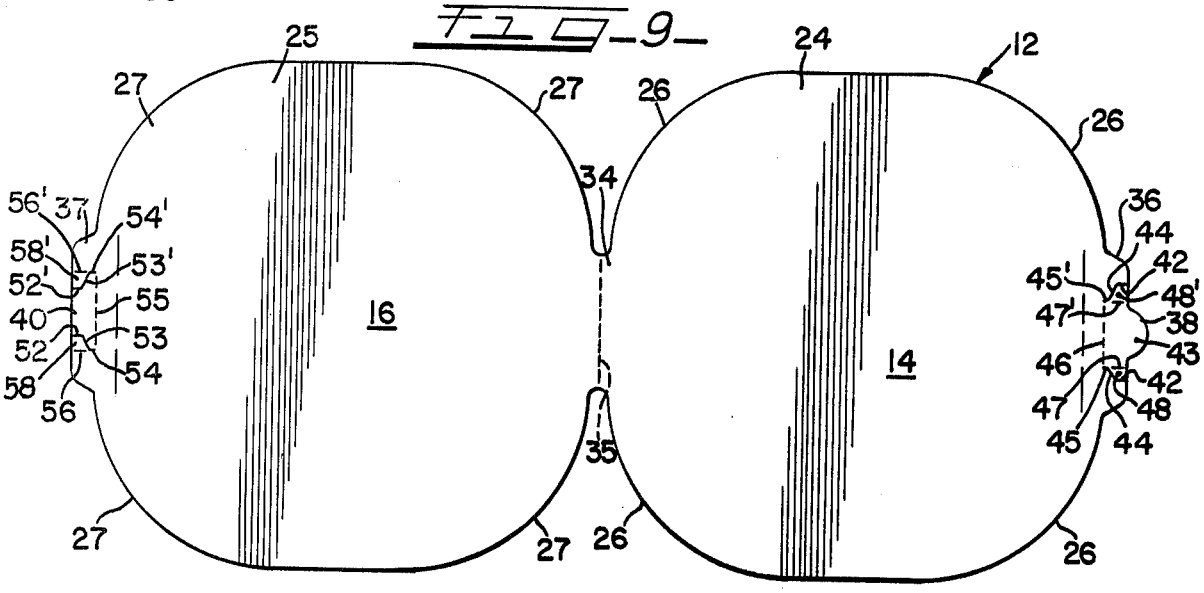

PACKAGING CONTAINER WITH LATCHING ARRANGEMENT

BACKGROUND OF THE INVENTION

This invention relates to packaging and is more particularly concerned with improvements in container structures which are in the form of a clam shell and which are particularly adapted for rapid packaging and handling of fast food products or other articles.

In the rapidly developing fast food industry the handling of the food products for delivery to the customer requires the use of inexpensive containers which may be filled and closed rapidly and which will enable the customer to carry out the products with assurance that the closed container will not accidentally open and spill the contents, but will remain closed until opened by the customer. A number of different type containers have been employed which are of a size and shape to hold a sandwich or other product of similar dimensions or bulk. Some of these, which have generally been fabricated from foam plastic and take the form of a pair of hingedly connected tray-like members, have been used in large numbers. However, they have not been found fully satisfactory by the customer generally because they lack adequate latching arrangements, when closed, and are too prone to open and spill the contents when they are not carefully handled.

It is a general object of the present invention to provide a packaging device in the form of tray-like container which may be economically fabricated from paperboard, or like material, and which is so constructed that when filled, closed, and latched, it is not likely to be accidentally opened upon careless handling.

It is a more specific object of the invention to provide a container of the hinged tray type which may be readily stamped from a paperboard blank with an integral locking or latching arrangement which permits careless handling, likely to be encountered, with little risk of accidental opening.

It is a further object of the invention to provide a container of the hingedly connected tray or clam shell type which is particularly adapted to be formed from a paperboard blank with an integral locking arrangement which is adequate to guard against accidental opening when handled in a relatively careless manner.

It is another object of the invention to provide a container which is particularly adapted for use in packaging sandwiches, or similar items, such as presently marketed in fast food operations, which may be readily formed from a single blank of paperboard or the like, enabling the container to be satisfactorily printed and given a more asthetic appearance than foam plastic, while permitting it to be subjected to considerable heat from infra red heat lamps, warming ovens, or the like, without damage, and at the same time being biodegradable so as to be more readily disposable and less objectionable to environmentalists and conservationists.

To this end the packaging device herein described and claimed comprises a container fabricated from a blank of paperboard, or like material, so as to form a pair of hingedly connected members, one of which is in the form of a tray having flange forming portions opposite hinged edge portions which include integral latching elements adapted to be interengaged when the container members are closed upon each other and to hold the container members in closed position.

The invention will be best understood when consideration is given to the preferred form of the container which is herein described and illustrated in the accompanying drawings wherein like elements are identified by the same numerals throughout the several views thereof.

IN THE DRAWINGS

FIG. 1 is a perspective view of a hinged tray type container which embodies the principles of the invention, the view showing the container in closed and latched condition;

FIG. 2 is a top plan view of the container shown in FIG. 1;

FIG. 3 is an elevational view showing the latched side of the closed container;

FIG. 4 is a fragmentary perspective view, to a larger scale, showing the latch forming portions of the two container members in a position just prior to latching engagement;

FIG. 5 is a fragmentary top plan view, to an enlarged scale, showing the latch elements in engaged position;

FIG. 6 is a fragmentary elevational view, to an enlarged scale, showing the latch elements in engaged position;

FIG. 7 is a fragmentary bottom plan view, to an enlarged scale, showing the latch elements in engaged position;

FIG. 8 is a fragmentary cross sectional view taken on the line 8—8 of FIG. 6, to a still larger scale; and FIG. 9 is a plan view of a paperboard blank cut and scored preparatory to forming the container of FIG. 1.

DESCRIPTION OF THE PREFERRED EMBODIMENTS OF THE INVENTION

Referring particularly to FIGS. 1 and 9, the packaging container or carton 10 of FIG. 1 is formed from a one piece integral blank 12 of paperboard, or similar sheet material, which is relatively inexpensive, readily available and biodegradable, so that the carton may be used in large quantities, such as, for packaging certain food products by the fast food industry, and also satisfy environmental requirements as well as replacement needs.

The blank 12 comprises two generally square panels 14 and 16 of dimensions sufficient to form a pair of tray-like container members 18 and 20 (FIG. 1) which may be referred to as top and bottom carton members, one forming a product receiving member and the other a cover member. The blank 12 may be die formed or otherwise shaped to form the tray members 18 and 20 with peripherial flange formations 22 and 23 being formed from marginal edge portions 24 and 25 of the two panels 14 and 16, each of which has its four corners rounded, as shown at 26 and 27 in FIG. 9, so as to permit forming of the carton with a rounded corner configuration as shown in FIGS. 1 to 3.

The two tray members 18 and 20 are shaped to provide an identical configuration with the top member 18 having a square top wall panel 28 and peripherial side walls 30 tapering outwardly from the panel edges to the inner edge of the peripherial flange formation 22 and with the bottom member 20 having a square bottom wall panel 32 and peripherial side walls 33 tapering outwardly to the inner edges of the peripherial flange formation 23.

The blank 12 has a hinge forming portion 34 integrally connecting adjacent edge portions with a perforated line 35 marking the hinge line. Along the opposite edges the two panels 14 and 16 have flange or marginal edge extensions 36 and 37 in which integral latch members 38 and 40 are cut and scored for cooperation in forming a container closure latch, as hereinafter described, when the container members 18 and 20 are closed upon each other.

The latch element 38 on the top forming panel 14 is cut in the flange extension 36 on the parallel lines 42, 42' which are spaced on either side of a finger tab 43, the latter extending or projecting outwardly of the outermost edge of the flange extension 36. The cutting lines 42, 42' have inner portions 44, 44' which converge toward each other and extend to short parallel lines 45, 45', with the latter terminating at a perforated hinge line 46. The hinge line 46 is approximately aligned with the outermost edges of the blank which adjoin the flange extension 36. Parallel score lines 47, 47' are spaced approximately equidistant from the cutting line portions 42, 42' and are separated from each other a distance corresponding approximately to the length of the perforation line 46. The score lines 47, 47' serve as break lines or hinge lines for the locking tabs or ear formations 48, 48' which are defined by the score lines 47, 47' and the cutting lines 42, 44 and 42', 44'.

The latch element 40 on the bottom forming panel 16, which is in the form of a small panel, is cut in the flange extension 37 on the parallel spaced lines 52, 52' which have diverging inner portions 53, 53' extending to short parallel lines 54, 54', the latter terminating at the ends of a perforated hinge line 55. The outermost cutting line portions 52, 52' are spaced apart a distance substantially less than the distance between the cutting line portions 45, 54' while the cutting line portions 54, 54' are spaced apart a distance corresponding approximately to the distance between cutting line portions 45, 45'. Parallel score lines 56, 56' extend from the edge of the blank inwardly to the short cutting lines 54, 54' and with the cutting line portions 52, 53 and 52', 53' define latching tabs or ear formations 58, 58' extending from the flange material inwardly toward each other and on opposite sides of the resulting latching slot.

The two panels 14 and 16 are scored on the lines 60 and 62 to indicate the inner edges of the peripherial flanges 22 and 23 and to facilitate positioning of the blank in the forming dies.

In using the carton 10, it may be filled with a product and the two tray members hinged to a closed position with the flanges 22 and 23 overlying each other and with the latch elements 38 and 40 in overlying relation whereupon the latch element 38 may be swung about the hinge line and against the latch element 40 until the ears 48 and 48' on the element 38 slip past the ears 58 and 58' on the flange 23, with the latch element 40 hinging on the line 55. Upon releasing the element 38 the two hinged elements will tend to swing back into the plane of the flanges 22 and 23 with the ears interlocked so as to form a positive latch and hold the carton members 18 and 20 in closed position, the latch element 40 serving as a lock or catch in holding the latching ears in engagement and against disengagement of the latch element 38 from the aperture or slot resulting from the cutting of the latch element 40 in the flange extension 37.

I claim:

1. A readily disposable container which is formed from a single blank of cut and scored paperboard, or similar sheet material of a character which enables forming the container elements by die shaping, said container comprising a tray-like product accommodating member and a cover member of like configuration, with cooperating sidewalls having a hinged connection along one side thereof and cooperating latch elements, said container forming members each having peripherial flange formations extending outboard of the free edges of the sidewalls which flange formations are disposed so as to overlie each other in the closed position of said members, the hinged connection being at the outer edges of the flange formations and said latch elements being cut in outboard extensions of said flange formations which are brought into registry with each other when said cover member is closed on said product accommodating member so as to permit interengagement of said latch elements, said latch elements comprising a hinged tab member cut in the flange extension of said container cover member and a cooperating slot cut in the flange extension of said product accommodating member, said hinged tab member being defined by laterally spaced cuts extending inboard of the free outer edge of said flange extension, which cuts have their innermost portions converging toward each other and terminating at short parallel cutting lines which extend to a hinge line which is approximately aligned with the outermost edges of the flange formation adjoining the flange extension so as to form small ear formations extending from opposite side edges and adjacent the free outer edge portions of said tab member, the latch forming slot which is cut in the flange formation of the product accommodating member being defined by laterally spaced cuts extending inboard of the free outer edge thereof so as to form a portion at the free margin thereof of lesser width than the distance between the ear formations on said tab member and so as to leave small ear formations on the adjoining flange portions which extend inwardly toward each other and interengage with the ear formations on said tab member when said tab member and said latch forming panel are swung into position, and a small hinged panel member formed in the area which is cut out to form said latch forming slot which hinged panel member serves as a catch for holding the latching ears in engagement.

* * * * *